US007568591B2

(12) United States Patent
Tedford, Jr.

(10) Patent No.: US 7,568,591 B2
(45) Date of Patent: Aug. 4, 2009

(54) FRANGIBLE ATTACHMENT FOR THERMOFORMED LID SPOUT CLOSURE

(75) Inventor: Richard A. Tedford, Jr., Loveland, OH (US)

(73) Assignee: International Paper, Loveland, OH (US)

( * ) Notice: Subject to any disclaimer, the term of this patent is extended or adjusted under 35 U.S.C. 154(b) by 341 days.

(21) Appl. No.: 11/435,310

(22) Filed: May 16, 2006

(65) Prior Publication Data

US 2006/0255043 A1 Nov. 16, 2006

Related U.S. Application Data

(60) Provisional application No. 60/681,532, filed on May 16, 2005.

(51) Int. Cl.
*B65D 41/32* (2006.01)
*A47G 19/22* (2006.01)
*B65D 41/46* (2006.01)

(52) U.S. Cl. ..... 220/266; 220/254.7; 220/375; 220/713

(58) Field of Classification Search ..... 220/713, 220/266, 714, 717, 254.3, 712, 276, 254.7
See application file for complete search history.

(56) References Cited

U.S. PATENT DOCUMENTS

| | | | | |
|---|---|---|---|---|
| 3,670,919 | A | 6/1972 | Prayer et al. | |
| 4,347,946 | A * | 9/1982 | Nichols | 220/375 |
| 4,449,640 | A * | 5/1984 | Finkelstein | 220/270 |
| 5,667,094 | A * | 9/1997 | Rapchak et al. | 220/834 |
| 5,699,927 | A | 12/1997 | Lane et al. | |
| 6,554,154 | B1 | 4/2003 | Chauhan et al. | |
| 6,644,490 | B2 * | 11/2003 | Clarke | 220/254.1 |
| 6,679,397 | B2 * | 1/2004 | Smith et al. | 220/254.1 |
| 6,732,875 | B2 | 5/2004 | Smith et al. | |
| 6,886,707 | B2 | 5/2005 | Giraud | |
| 7,134,566 | B2 * | 11/2006 | Smith et al. | 220/254.1 |
| 7,175,042 | B2 * | 2/2007 | Durdon | 220/254.3 |
| 2002/0170912 | A1 * | 11/2002 | Clarke | 220/254.1 |
| 2003/0024930 | A1 * | 2/2003 | Smith et al. | 220/254.1 |
| 2004/0256386 | A1 * | 12/2004 | LaFortune | 220/254.1 |
| 2004/0256387 | A1 * | 12/2004 | Smith | 220/254.3 |
| 2005/0035124 | A1 * | 2/2005 | Smith et al. | 220/254.1 |

* cited by examiner

*Primary Examiner*—Anthony D Stashick
*Assistant Examiner*—Niki M Eloshway
(74) *Attorney, Agent, or Firm*—Daniel Stelter; Thomas W. Ryan, III; Thomas W. Barnes, III

(57) ABSTRACT

A lid is provided for use as a cover on a beverage container or other dispensing device, wherein the lid includes a dispensing spout therein for dispensing of the container contents therefrom. A flexible connector arm extends around at least a portion of the periphery of the lid and includes a fixed end fixedly attached to the lid at a first arcuate position thereof and a free end frangibly connected to the lid by a frangible tab located at a second arcuate position of the lid. The free end of the connector arm can be detached from the lid by tearing along a tear line provided in the connector arm spaced radially outwardly from the frangible tab. In this manner, detaching of connector arm from the lid occurs by a discrete tear line propagated through the connector arm, rather than through the lid flange, thereby allowing for detachment of the connector arm from the lid without compromising the integrity of the seal between the lid and the cup. A plug may be provided near the free end of the connector arm, which such plug may be removably inserted into dispensing spout of the lid once the connector arm is detached from the lid.

18 Claims, 3 Drawing Sheets

FRANGIBLE ATTACHMENT FOR THERMOFORMED LID SPOUT CLOSURE

BACKGROUND OF THE INVENTION

1. Technical Field of the Invention

The present invention relates to thermoformed lids for use as covers on beverage containers and other dispensing devices. More particularly, the present invention relates to thermoformed lids for use as covers on beverage containers and other dispensing devices, wherein the lid includes a dispensing spout and wherein a closure plug is tethered to the lid by means of a connecting arm frangibly attached to the lid.

2. Brief Description of the Related Art

Thermoformed lids for use as covers on beverage containers and other dispensing devices are well known in the art. A typical thermoformed lid fits over an open upper end of a container, such as a beverage cup, and is adapted to be sealingly affixed thereto so as to minimize the risk of spillage from the cup, for example, in the event the cup is tipped over inadvertently.

According to one conventional container arrangement known in the art, the lid includes a circular flange which is snap-fit over a circular lip provided near the open upper end of the cup. In such an arrangement, the lid can be removed from the cup (and re-affixed thereto) by snapping the lid flange off of (and back on to) the cup lip so as to allow for pouring or otherwise dispensing of the container contents, when desired.

However, such an arrangement requires the user thereof to remove the lid each time the user desires to dispense liquid therefrom. In conventional beverage containers, such as coffee cups, it is inconvenient to the end user to require that the lid be removed from the cup each time the user desires to drink from the cup. As such, it is well-known in the art to provide a dispensing spout in the lid so as to allow the user to pour (or otherwise dispense) liquid from the cup without removing the lid from the cup. In such arrangements, it is typical for the dispensing spout to be relatively small, so as to allow for reasonable dispensing therethrough while still generally enclosing the open upper end of the cup so as to minimize the risk of spillage therefrom during ordinary use. It is desirable therefore to provide a lid for use as a cover on a container, such as, for example, a beverage cup, wherein the lid is adapted to inhibit spillage of the container contents therefrom. It is furthermore desirable to provide a lid for use as a cover on a container, such as, for example, a beverage cup, wherein the lid is adapted to inhibit spillage of the container contents therefrom and wherein the lid is provided with a dispensing spout for the purpose of dispensing container contents therefrom.

It is also known, however, to provide a removable plug or other sealing device for the purpose of closing the dispensing spout when the spout is not required to be open. In the case of hot beverages, sealing the dispensing spout aids in keeping the beverage hot, and in the case of cold beverages, sealing the dispensing spout aids in keeping the beverage cold. Furthermore, sealing the dispensing spout reduces the risk of spillage of the container contents from the spout, for example, if the container is tipped over.

Because it typically is easier to remove the removable plug from the spout than it is to remove the lid from the cup, it is less inconvenient for the user to remove the plug each time the user desires to drink from the cup. It is desirable, therefore, to provide a lid for use as a cover on a container, such as, for example, a beverage cup, wherein the lid is adapted to inhibit spillage of the container contents therefrom, wherein the lid is provided with a dispensing spout for the purpose of dispensing container contents therefrom and wherein a removable plug is provided to close the dispensing spout so as to inhibit spillage of the container contents.

Removable plugs known in the art, however, typically are separate from the lid and/or the cup, and may be misplaced or inadvertently discarded, in which case, the user is unable to close the dispensing spout for the purposes stated above. As such, it is known to attach the plug to the cup and/or lid in some manner so as to prevent disassociation of the plug from the container. One such lid is shown in U.S. Pat. No. 6,679,397, wherein the closure member is tethered to the lid by a flexible connector arm, which is formed at one end thereof integrally with a flange portion of the lid. A free end of the connector arm includes a plug and may be attached to the flange portion of the lid by a small securing tab, which is formed integrally with both the free end of the connector arm and the flange portion of the lid. A user detaches the free end of the connector arm by tearing through the securing tab, thereby allowing the user to insert a plug provided on the free end of the connector arm into a drink opening formed in the lid.

It has been observed, however, that when such a connector arm is attached to the lid in the manner described in U.S. Pat. No. 6,679,397, detaching the free end of the connector arm from the lid oftentimes results in tearing of the flange portion of the lid, thereby breaching the integrity of the seal between the lid and the cup. It is desirable, therefore, to provide a lid for use as a cover on a container, such as, for example, a beverage cup, wherein detachment of such a connector arm from the lid can be achieved without breaching the integrity of the seal between the lid and the cup.

SUMMARY OF THE INVENTION

According to one aspect of the present invention, a lid is provided for use as a cover on a beverage container or other dispensing device, wherein the lid includes a dispensing spout therein for dispensing of the container contents therefrom. A flexible connector arm extends around at least a portion of the periphery of the lid and includes a fixed end fixedly attached to the lid at a first arcuate position thereof and a free end frangibly connected to the lid by a frangible tab located at a second arcuate position of the lid. The free end of the connector arm can be detached from the lid by tearing along a tear line provided in the connector arm spaced radially outwardly from the frangible tab. In this manner, detaching of connector arm from the lid occurs by a discrete tear line propagated through the connector arm, rather than through the lid flange, thereby allowing for detachment of the connector arm from the lid without compromising the integrity of the seal between the lid and the cup. A plug may be provided near the free end of the connector arm, which such plug may be removably inserted into dispensing spout of the lid once the connector arm is detached from the lid.

In one embodiment of the present invention, the scoreline extends away from a distal edge of the free end of the connector arm, spaced radially outwardly from the frangible tab in a direction generally tangential to (or away from) the lid, thereby minimizing the risk of tearing the frangible tab, and thereby minimizing the risk of compromising the integrity of the seal between the lid and the cup.

It is an object of the present invention to provide a lid for use as a cover on a container, such as, for example, a beverage cup, wherein the lid is adapted to inhibit spillage of the container contents therefrom, It is another object of the present invention to provide a lid for use as a cover on a container, such as, for example, a beverage cup, wherein the lid is provided with a dispensing spout for the purpose of dispensing container contents therefrom and wherein a removable plug is provided to close the dispensing spout so as to inhibit spillage of the container contents.

It is yet another object of the present invention to provide a lid for use as a cover on a container, such as, for example, a beverage cup, wherein the lid is provided with a dispensing spout for the purpose of dispensing container contents therefrom, wherein a removable plug is provided on a connector arm to close the dispensing spout so as to inhibit spillage of the container contents and wherein detachment of such a connector arm from the lid can be achieved without breaching the integrity of the seal between the lid and the cup.

These and other objects, features and advantages of the present invention become apparent to those of ordinary skill in the art from the description which follows, and may be realized by means of the instrumentalities and combinations particularly pointed out therein, as well as by those instrumentalities, combinations and improvements thereof which are not described expressly therein, but which would be obvious to those of ordinary and reasonable skill in the art.

A lid for use as a cover on a beverage container according to a preferred embodiment of the present invention includes a top wall, a sidewall depending downwardly from the top wall and a connector arm extending from the sidewall, the connector arm having a fixed end fixedly attached to the sidewall and a free end removably attached to the sidewall, the free end of said connector arm being attached to the sidewall by a connecting tab, wherein the free end of said connector arm includes a tearline spaced radially-outwardly from the connecting tab.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAILED DESCRIPTION OF THE PREFERRED EMBODIMENTS

Figure 1:
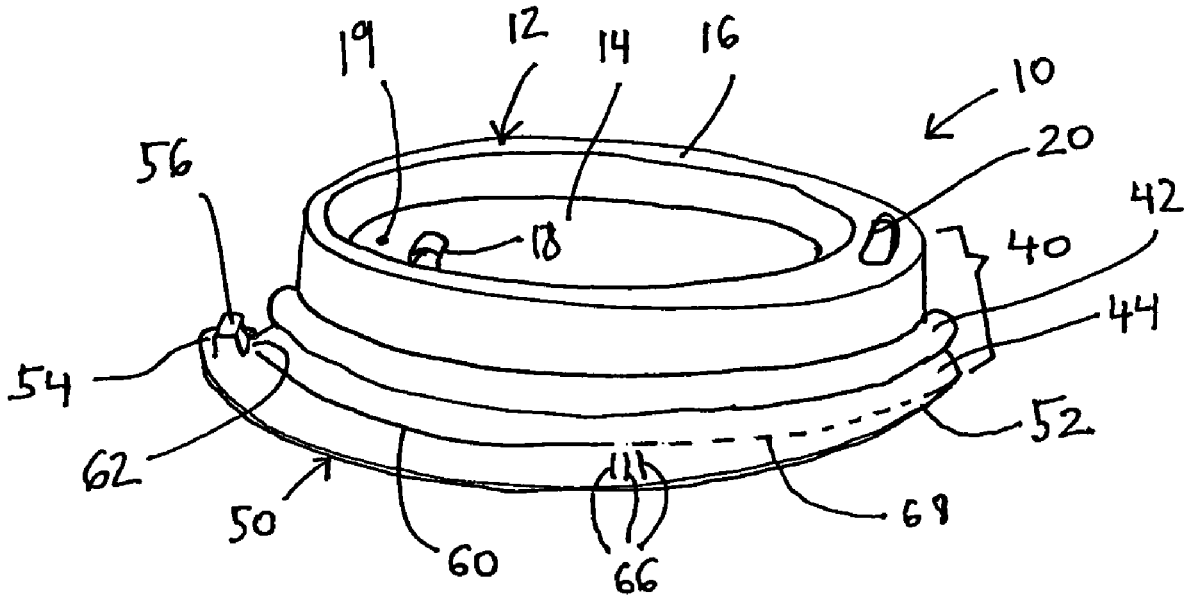
FIG. 1 is an exploded perspective view of a lid according to a preferred embodiment of the present invention shown in spaced relation to a container, such as a beverage cup.
Figure 1:
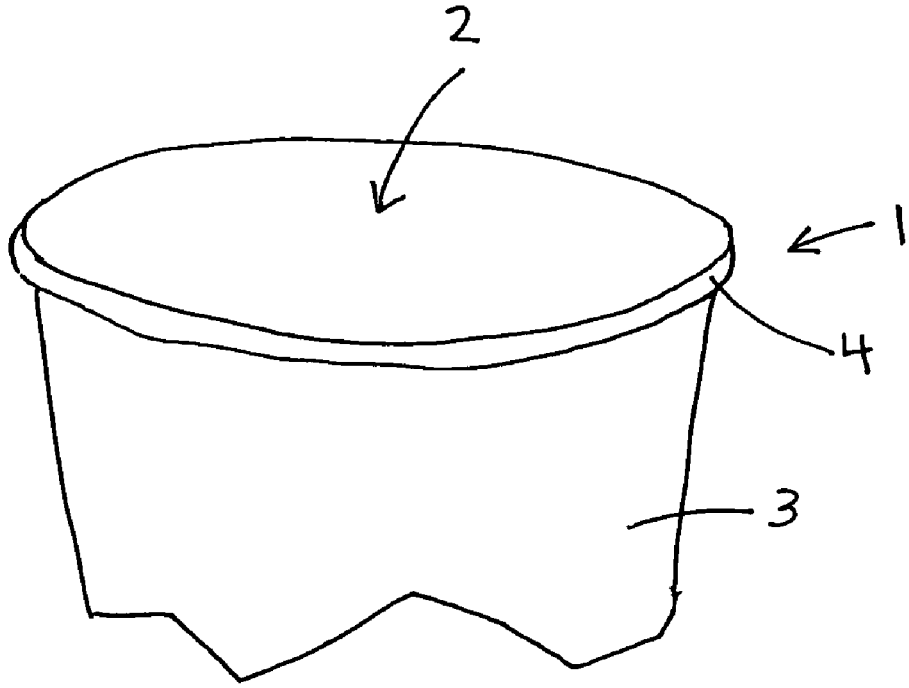

With reference to FIG. 1, a lid 10 according to a preferred embodiment of the present invention is shown in spaced relation to a conventional container 1, such as a beverage cup, or the like, and is used to cover an open upper end 2 of the container 1 in a manner so as to reduce the risk of spillage of container contents (not shown), such as, for example, if the container 1 is inadvertently tipped over. The container 1 includes a side wall 3 and a bottom wall (not shown), which cooperate with one another to define an interior space thereof into which container contents, such as liquids (for example, hot or cold beverages) or other flowable substances can be poured through the open upper end 2 thereof. The container side wall 3 may terminate at the open upper end 2 by a rolled lip 4, upon which the lid 10 is snap-fit, as described in greater detail below.

The container 1 may be constructed from any material, which may be reusable (such as certain plastics) or disposable (such as paper, paperboard, foam, film and combinations thereof). The size, shape and configuration of the container 1 is immaterial to the present invention, and any such sized, shaped or configured container 1 may be used, provided the lid 10 is adapted to fit over the open upper end 2 thereof. The lid 10 may be constructed from any flexible material, but is preferably constructed from a thermo-formable polymeric material suitable for shaping into thin-walled constructions.

According to conventional lidded container arrangements, the lid 10 is provided with an annular sealing flange 42 in the sidewall 40 portion of the lid 10. As will be described in greater detail below, the sealing flange 42 is adapted to snap-fit over the rolled lip 4 of the container 1, in a mating relationship so as to prevent leakage of container contents therefrom. Those of ordinary skill in the art will understand, upon reading the within description, that the present invention does not require a particular sealing arrangement between the lid 10 and the container 1 and that any such arrangement may be utilized without departing from either the spirit or the scope of the present invention. Further, while the preferred embodiments of the present invention have been described with reference to a two-piece container arrangement whereby a removable lid 10 is provided for use with a cup-like container 1, those of ordinary skill in the art will understand, upon reading the within description, that a one-piece container arrangement may be utilized without departing from either the spirit or the scope of the present invention.

Figure 2:
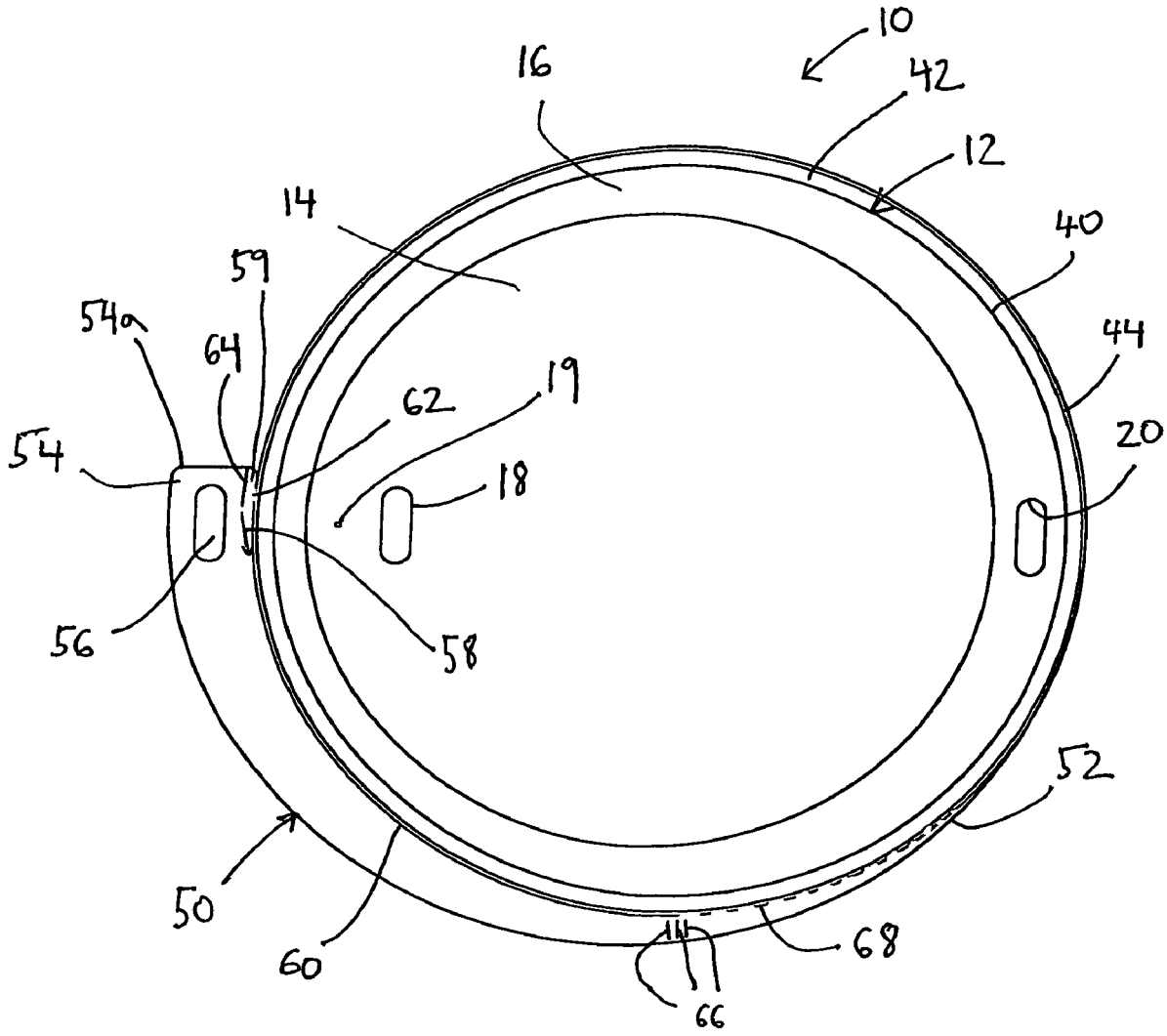
FIG. 2 is a plan view of the lid of FIG. 1, showing a connecting arm portion of the lid attached thereto and in a first position.
Figure 3:
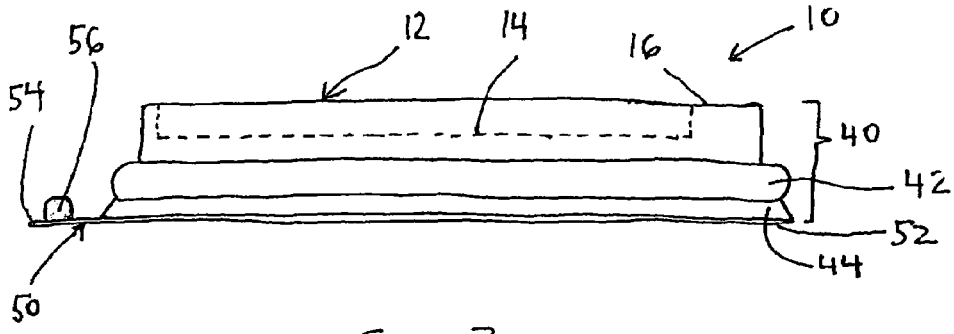
FIG. 3 is a side view of the lid with connecting arm portion attached thereto shown in FIG. 2; and, FIG. 4 is a partial close-up plan view of a free end of the connecting arm portion of the lid shown in FIG. 2.

Turning now to FIGS. 2 and 3, the lid 10 according to a preferred embodiment of the present invention will be described in greater detail. The lid 10 includes a generally-circular top wall 12 and generally-cylindrical sidewall 40 that depends downwardly from an outer periphery of the top wall 12. The top wall 12 may include a centrally-located, downwardly-stepped landing surface 14, thereby defining an annular raised shoulder 16 traversing the outer periphery of the top wall 12. The landing surface 14 may be circular in shape and may be concentric with the shoulder 16 (in which case the shoulder 16 has a constant width throughout) or, as shown in the Figures, the center of landing surface 14 may be offset from the center of the shoulder 16, thereby defining a greater width to the shoulder 16 at one end thereof. A dispensing spout 20 is provided in the top wall 12, preferably in the shoulder 16 at a first annular position on the lid 10.

The sidewall 40 includes a vertical segment 42 defining the upper distal end of the sidewall 40, an annular sealing flange 42 provided near the lowermost peripheral edge of the sidewall 40 and an annular skirt 44 extending from the sealing flange 42 and defining the lower distal end of the sidewall 40. Sealing flange 42 has a generally rounded cross-section so as to sealingly fit over the rolled lip 4 of the container 1 and annular skirt 44 has a generally outwardly-flared orientation so as to guide the lid 10 onto the open upper end 2 of the container 1, for example, when a user desires to affix the lid 10 thereto.

A flexible connector arm 50 is integrally-formed with the lid 10, extending outwardly from the lowermost peripheral edge of the annular skirt 44, and sweeping through an arcuate segment starting with a fixed end 52 thereof located at the first annular position of the lid 10 (near the dispensing spout 20) and ending with a free end 54 thereof located at a second annular position of the lid 10 (approximately 180 degrees from the first annular position, relative to the center of the top wall 12). It will be apparent to those of ordinary skill in the art, upon reading the within description, that the locations of the first and second annular positions are immaterial to the present invention and that the connector arm 50 may be configured to sweep through an arcuate segment greater to or less than that shown and described herein. The connector arm 50 lies generally in a plane perpendicular to the central axis of the top wall 12, although the connector arm 50 may lie in a plane oblique thereto.

According to one embodiment of the present invention, the connector arm 50 might be configured to have a gradually-increasing width, whereby an outermost edge of the connector arm has a diameter (relative to the central axis of the top wall 12) that equals the diameter (relative to the central axis of the top wall 12) of the outer peripheral edge of the annular skirt 44 at the first annular position, and whereby an outermost edge of the connector arm has a diameter (relative to the central axis of the top wall 12) that is greater than the diameter (relative to the central axis of the top wall 12) of the outer peripheral edge of the annular skirt 44 at the second annular position. A closure plug 56 is integrally-formed into the connector arm 50 near the free end 54 thereof and is sized, shaped and configured to sealingly fit within the dispensing spout 20 provided in the top wall 12, as will be described in greater detail below.

Although connector arm 50 is integrally-formed with the lid 10 (and in particular, with the annular skirt 44 of the lid 10), a scoreline 60 is provided between the annular skirt 44 and the connector arm 50 along an arcuate path between the second annular position (near the free end 54 of the connector arm 50) and a third annular position intermediate the first and second annular positions. Scoreline 60 is formed preferably by a stamping operation whereby the various cutouts and geometries of the lid 10 are formed and may pass completely through the thickness of the lid 10 (in which case, the scoreline 60 is actually a cut line) or may pass sufficiently through the thickness of the lid 10 so that the scoreline 60 forms a line of weakness along which the connector arm 50 can be detached from the lid 10 (and more particularly, detached from the annular skirt 44). As can be seen in the Figures, whereas first annular position is located near the dispensing spout 20 and second annular position is located near the free end 54 of the connector arm 50 (spaced approximately 180 degrees from the first annular position, relative to the central axis of the top wall 12), the third annular position (which is intermediate the first and second annular positions) preferably is spaced approximately 90 degrees from the first annular position, relative to the central axis of the top wall 12.

Figure 4:
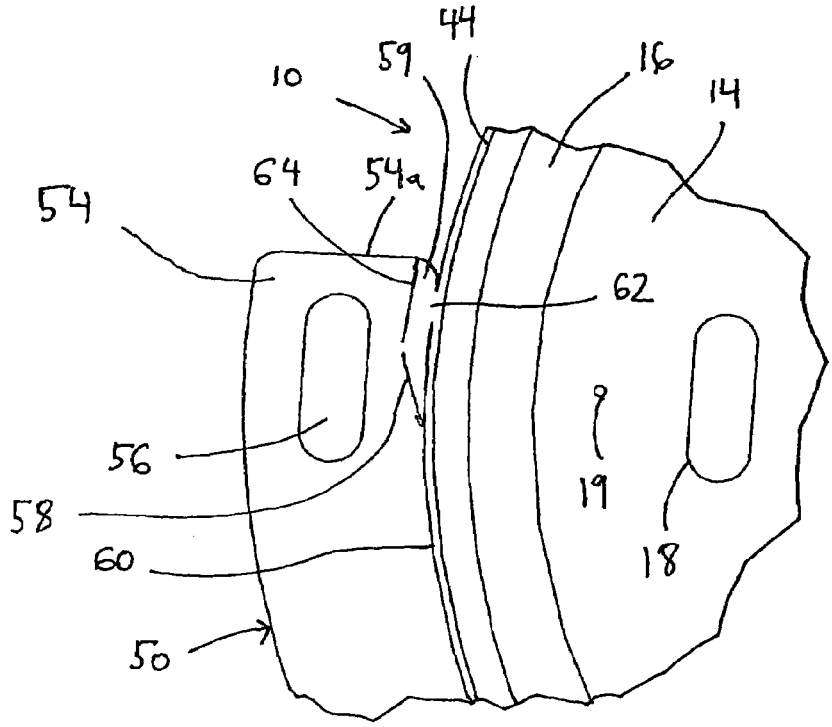

Referring now to FIG. 4, scoreline 60 is provided with an interruption near the free end 54 of the connector arm 50, thereby defining a thin connecting tab 62 which functions to secure the free end 54 of the connector arm 50 (albeit removably) to the annular skirt 44 so that the connector arm 50 may be held in a fixed position (relative to the annular skirt 44) until such time as a user wishes to detach the free end 54 of the connector arm 50 (as will be described in greater detail below) from the annular skirt 44. Interruption may be formed by providing a notch in the knives (not shown) used to form the scoreline 60 at a location corresponding to the desired location of the tab 62.

Tearline 64 is provided in the connector arm 50 spaced radially-outwardly from the connecting tab 62 and extending into the free end 54 of the connector arm 50 along a path that is parallel to a line that is generally tangent to the annular skirt 44 at the second annular position. Tearline 64 begins at the free edge 54*a* of the free end 54 of the connector arm 50 and extends past the connecting tab 62. Those of ordinary skill in the art will understand, upon reading the within description, that although the tearline 64 is shown as extending along a path that is generally parallel to a line tangent to the annular skirt 44 at the second annular position, tearline 64 may in fact extend along a line that moves generally towards or away from scoreline 60, so long as it is spaced radially-outwardly from the connecting tab 62 and extends annularly therebeyond.

Referring back to FIGS. 1 and 2, hinge depressions 66 may be provided in the connector arm 60 near the third annular position and may extend radially from the annular skirt 44 (as shown in the Figures) or may extend generally tangent thereto (not shown). Hinge depressions 66 enhance the flexibility of the connector arm 50 (as will be described in greater detail below) without causing scoreline 60 to propagate towards the first annular position (along the arc shown generally in dashed lines at 68).

Referring now again to FIG. 4, tearline 64 facilitates detachment of the free end 54 of the connector arm 50 without causing tearing of the annular skirt 44 and/or flange 42 by directing a tear through the connector arm 50 in a direction towards the scoreline 60, shown generally at reference number 58, rather than tearing through connecting tab 62, as is typical of container lids known in the art. Once detached from the annular skirt 44, free end 54 of the flexible connector arm 50 may be moved relative to the fixed end 52 thereof so as to allow the closure plug 56 provided near the free end 54 of the connector arm 50 to be sealingly inserted into the dispensing spout 20, thereby reducing the risk of spillage of container contents, for example, in the event the container 1 (with lid 10 attached) is tipped over inadvertently.

As can be seen from FIG. 4, detaching the connector arm 50 from the annular skirt 44 by tearing the connector arm 50 along path 58 will result in a frangible portion 59 of the connector arm 50 remaining attached to the annular skirt 44 by the connecting tab 62. Frangible portion 59 may be removed from the annular skirt 44, such as, by tearing connecting tab 62, although to do so may result in tearing annular skirt 44 itself, thereby increasing the risk that the integrity of the seal between the lid 10 and the container 1 is compromised. The present invention provides an advantage over the prior art in that frangible portion 59 (as defined by tearline 64 and tear path 58) allows for detachment of the connector arm 50 from the annular skirt 44 without compromising the integrity of the seal between the lid 10 and the container 1.

Recess 18 may be provided in the landing surface 14 of the top wall 12 to receive the closure plug 56, for example, when the user desires to dispense container contents therefrom and desires for the connector arm 50 to be held out of the way. In this manner, connector arm 50 may be moved repeatedly between the dispensing spout 20 (when it is desired to seal the container contents therein) and the recess 18 (when it is desired to dispense container contents therefrom. Vent hole 19 in the form of a simple puncture is located somewhere in the top wall 12, and preferably in the landing surface 14 near the recess 18) to allow for venting of container pressure, for example, where hot liquids such as coffee are contained within the container 1.

While the invention has been described and illustrated with reference to one or more preferred embodiments thereof, it is not the intention of the applicants that the invention be restricted to such detail. Rather, it is the intention of the applicants that the invention be defined by all equivalents, both suggested hereby and known to those of ordinary skill in the art, of the preferred embodiments falling within the scope hereof.

I claim:

1. A lid for use as a cover for an open-topped container, comprising:

a top wall;

a sidewall depending downwardly from said top wall; and, a connector arm extending from said sidewall, said connector arm having a fixed end fixedly attached to said sidewall and a free end removably attached to said sidewall, said free end of said connector arm being attached to said sidewall by a connecting tab, wherein said free end of said connector arm includes a tearline spaced radially-outwardly from said connecting tab and said tearline extends annularly beyond said connecting tab.

2. The lid according to claim 1, wherein said tearline extends along a path that is generally parallel to a line tangent to the sidewall.

3. The lid according to claim 1, wherein said connecting tab is defined by an interruption in a scoreline provided between said connector arm and said sidewall.

4. The lid according to claim 1, wherein said sidewall includes an annular vertical segment depending downwardly from said top wall, an annular sealing flange depending downwardly from said vertical segment, and an annular skirt projecting from said sealing flange, wherein said connector arm extends from said annular skirt.

5. The lid according to claim 1, wherein said connector arm extends between first and second annular positions of said lid.

6. The lid according to claim 5, wherein said second annular position is angularly spaced from said first annular position by an angle less than or equal to 180 degrees.

7. The lid according to claim 1, wherein said connector arm includes a closure plug located near said free end thereof.

8. The lid according to claim 1, wherein said top wall includes a dispensing spout.

9. The lid according to claim 8, wherein said connector arm includes a closure plug located near said free end thereof, and wherein said closure plug is adapted to be removably inserted at least partways into said dispensing spout.

10. The lid according to claim 9, wherein said top wall includes a recess adapted to receive said closure plug at least partways thereinto.

11. The lid according to claim 10, wherein said connector arm is adapted to move between a first and second position, wherein said closure plug is inserted at least partways into said dispensing spout when said connector arm is in said first position and wherein said closure plug is inserted at least partways into said recess when said connector arm is in said second position.

12. The lid according to claim 1, wherein said tearline defines a frangible portion of said connector arm that remains affixed to said sidewall when said connector arm is detached therefrom.

13. The lid according to claim 12, wherein said frangible portion of said connector arm may be removed from said sidewall after said connector arm is detached therefrom.

14. The lid according to claim 1, wherein said connector arm is adapted to be detached from said sidewall without tearing said sidewall.

15. The lid according to claim 14, wherein applying a shearing force to said tearline propagates a tear along a path through said connector arm in a direction towards a scoreline provided between said connector arm and said sidewall.

16. The lid according to claim 1, wherein said connector arm includes at least one hinge depressions.

17. The lid according to claim 1, further comprising a scoreline provided between said connector arm and said sidewall.

18. The lid according to claim 17, wherein said scoreline is a cut line.

* * * * *